US009045255B2

(12) United States Patent
Purtak

(10) Patent No.: US 9,045,255 B2
(45) Date of Patent: Jun. 2, 2015

(54) MODULAR CONTAINER SYSTEM

(71) Applicant: Marcin Purtak, Cieszyn (PL)

(72) Inventor: Marcin Purtak, Cieszyn (PL)

( * ) Notice: Subject to any disclaimer, the term of this patent is extended or adjusted under 35 U.S.C. 154(b) by 173 days.

(21) Appl. No.: 13/707,862

(22) Filed: Dec. 7, 2012

(65) Prior Publication Data

US 2014/0158682 A1 Jun. 12, 2014

(51) Int. Cl.
*B65D 21/02* (2006.01)

(52) U.S. Cl.
CPC ..... *B65D 21/023* (2013.01); *B65D 21/0204* (2013.01)

(58) Field of Classification Search
CPC . B65D 81/361; B65D 21/0204; B65D 21/023
USPC ..... 220/23.2, 23.4, 23.6, 23.83, 23.86, 220/23.87, 23.88, 23.89; 206/504, 511
See application file for complete search history.

(56) References Cited

U.S. PATENT DOCUMENTS

| | | | | | |
|---|---|---|---|---|---|
| 3,429,542 | A * | 2/1969 | Fagan | 248/313 |
| 3,610,409 | A * | 10/1971 | Graf | 206/543 |
| 4,133,445 | A * | 1/1979 | Mandelbaum | 220/23.4 |
| 4,228,897 | A * | 10/1980 | Underwood | 206/504 |
| 4,258,847 | A * | 3/1981 | Nierman | 206/504 |
| 4,685,565 | A * | 8/1987 | Sparling | 206/427 |
| 4,966,298 | A * | 10/1990 | Von Holdt | 220/23.4 |
| 4,982,858 | A * | 1/1991 | von Holdt | 220/23.4 |
| 5,469,961 | A * | 11/1995 | Chang | 206/312 |
| 5,638,974 | A * | 6/1997 | Mann | 220/23.4 |
| 5,769,230 | A * | 6/1998 | Koefelda | 206/508 |
| 6,129,229 | A * | 10/2000 | Dunn et al. | 220/4.22 |
| 6,296,541 | B1 * | 10/2001 | Bezalel et al. | 446/105 |
| 6,360,884 | B1 * | 3/2002 | Smith et al. | 206/209.1 |
| 7,506,778 | B2 * | 3/2009 | DaSilva et al. | 220/23.4 |
| 7,648,407 | B1 * | 1/2010 | Sorensen | 446/120 |
| 7,878,364 | B1 * | 2/2011 | Anderson | 220/735 |
| 7,900,791 | B2 * | 3/2011 | Zinoni et al. | 220/23.83 |
| 2005/0279744 | A1 * | 12/2005 | Conrad et al. | 220/23.4 |

FOREIGN PATENT DOCUMENTS

| | | |
|---|---|---|
| PL | 175252 | 11/1998 |

* cited by examiner

*Primary Examiner* — Fenn Mathew
*Assistant Examiner* — Christopher McKinley
(74) *Attorney, Agent, or Firm* — Katten Muchin Rosenman LLP

(57) ABSTRACT

A modular container system, consisting of at least one container, characterized in that having at least one monolithic housing (1) consisting a back wall (2), having an opening (3) for a screw and an area (3*a*) for double-sided adhesive tape; sidewalls (4); connection clips (5) attached to the back wall; a cover (6) equipped with pins (16) allowing installation of illumination; a base (7); a plastic insert (9) of cylindrical shape, enclosed at its base; a vertical attachment system consisting of vertical, male, sliding shape connector (10); and a vertical female connector; a horizontal attachment system consisting of top openings (12) and bottom openings (13), and a horizontal connector (14); a safety system consisting of a lock (17); and a system allowing to create a portable configuration, consisting of a base (19) containing a female vertical connector (20) and a handle (21*a*) and (21*b*).

14 Claims, 6 Drawing Sheets

MODULAR CONTAINER SYSTEM

Figure 1:
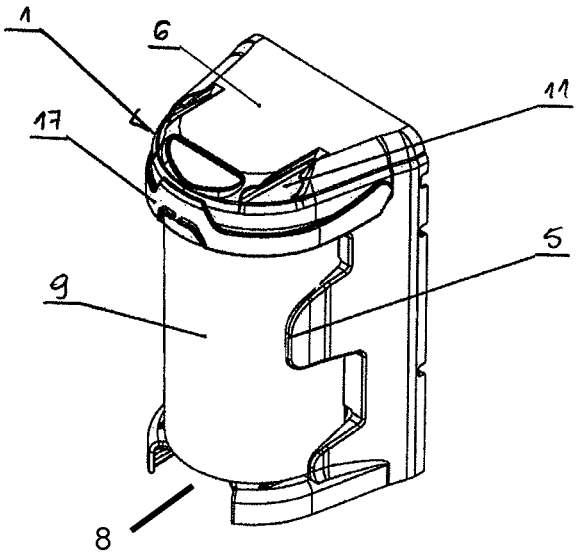

The invention relates to a modular container system, designed to store small objects of different purpose, with possibility to arrange the containers in stationary or portable multiple configurations.

It is known from U.S. Pat. No. 175,252 a set of containers, consisting of at least two containers, of which at least one part is of a shape of cylinder, with an area on its side surface on which attachment elements are positioned; the attachment elements of at least two containers form a sliding shape connection, characterised in the fact that the first and second containers are attached in a rotary and sliding manner along the axes of the attachment elements; the attachment elements of the first container are fitted to the attachment elements of the second container, creating a shape connection between both containers, the shape connection pointing the containers' radiuses.

A system of drawers is known designed to hold small electric, fishing or other accessories; created as an integrated system, consisting of a specified amount of drawers and a monolithic housing. Its major drawback is constant and specified by the producer amount of drawers available, without possibility to modify their number and also lack of possibility to modify the shape of the housing. The amount of the drawers may be changed only by attaching another drawers set.

There are also known systems of portable containers for small objects, consisting of a box and a fixed amount of dividers. The system may have one or more levels with dividers, but again its major drawback is lack of possibility to change the number of dividers and also their fixed shape.

The aim of the invention is creating a system allowing to use free, unused spaces on garage or workshop walls that would help keep small objects well organised.

The object of the invention is a modular container system consisting of at least one container, characterised by having at least one monolithic housing comprising back wall in the shape of a vertical column in its middle portion, an opening for a screw and an area for double-sided adhesive tape. Moreover, it consists of sidewalls made from flat vertical projections, their back edges forming enclosure of the back wall; a connection clip attached to the back wall; a cover, in which the back area ends with a straight flat surface, a hoop runs from this surface around the whole cover, being circular in shape in its front portion; a base, which is underlined with a hoop that projects from the sidewalls; a concave gap with its arc directed towards the back wall of the housing; and at least one insert made of plastic, of cylindrical shape, enclosed at its base. The modular container system includes a system for vertical attachment comprising of male vertical sliding shape connector at the bottom portion of the base, being a boss which in transverse cross-section is tri-arm shaped with two bottom arms rounded; and of a female vertical connector, being a longitudinal slot in the cover. The modular container system consists also of horizontal attachment system comprising of two openings on the side walls of the housing and a vertical connector, which in transverse cross-section has a shape of two rings linked by a bar. The modular container system includes a safety system which prevents the containers from falling out, consisting of a lock, being a semicircular bail, fixed on both sides of the upper portion of the housing; and also includes a system for creating a portable configuration, which comprises a base equipped with a female vertical connector, and a handle equipped with male vertical sliding shape connector which allows to attach it to the housing. Additionally, the handle is equipped with a switch for operating illumination system.

Favourably joint depth of vertical projections and connection clips is not greater than half of the container's radius.

Favourably the cover's radius, which in its front portion is of semicircular shape, which is correspondent with the container's radius.

Favourably the base's hoop is of the same height as the cover's hoop.

Favourably the plastic insert is transparent.

Favourably the horizontal connector is mounted on a hook for hanging on a exhibition shelf, which is detachable from the housing.

Favourably the housing is of a colour matching the interior.

Favourably the lock of the safety system which prevents the containers from falling out has projections on the inner portion of the bail's ends.

Favourably the lock of the safety system which prevents the containers from falling out has, at a quarter length from the bail's end, a thickened area.

Favourably the base is of width equal to doubled housing's depth.

Favourably the base is of length equal to multiplied housing's width.

Favourably the handle consists of two separable elements.

Favourably the handle is of width equal to doubled housing's depth.

Favourably the handle is of length equal to multiplied housing's width.

Thanks to a vertical surface fixing system that uses screws and/or two-sided adhesive tape the modular container system allows to use free spaces on any wall, and allows to fix the containers in for a constant and stable use.

Thanks to vertical and horizontal attachment system the modular container system allows to freely set the containers, choose desired amount and arrange them in a shape that optimally uses free space.

Additionally, the modular container system meets the aesthetic value because if well matched with the colour of the interior, the containers may become a decorative element.

Figure 2:
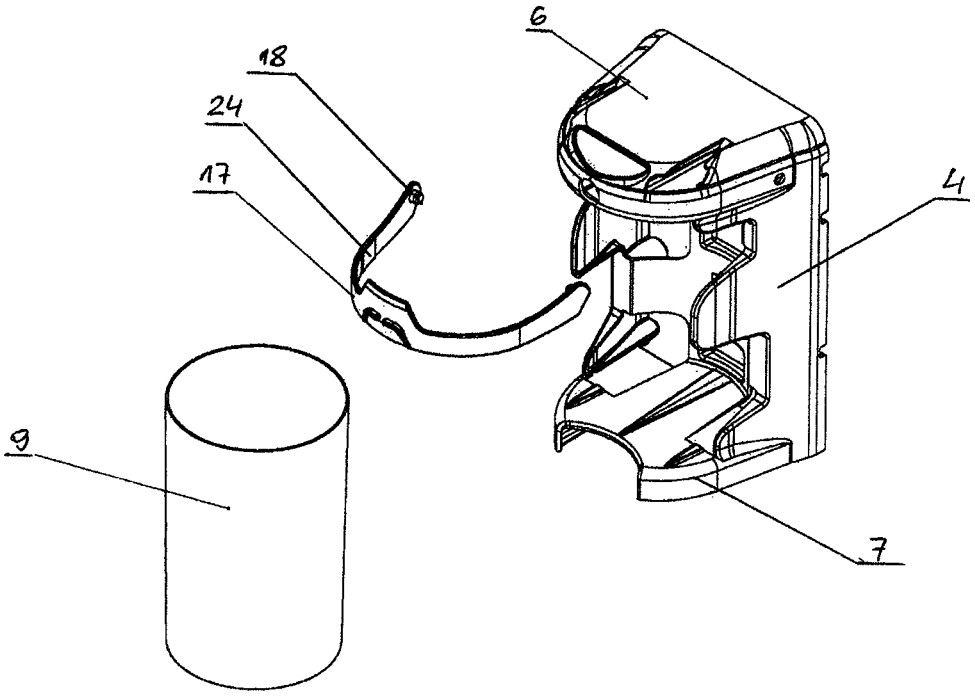
Figure 3:
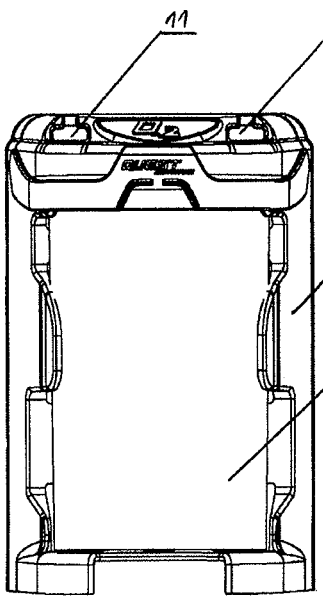
Figure 4:
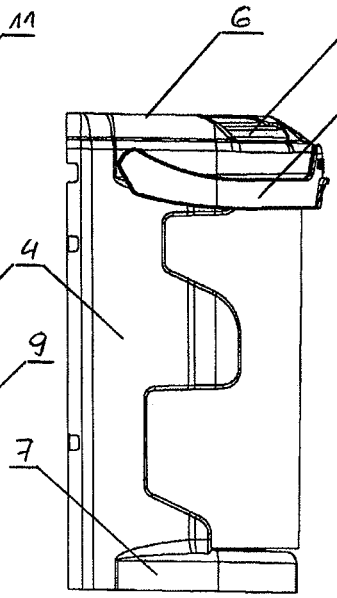
Figure 5:
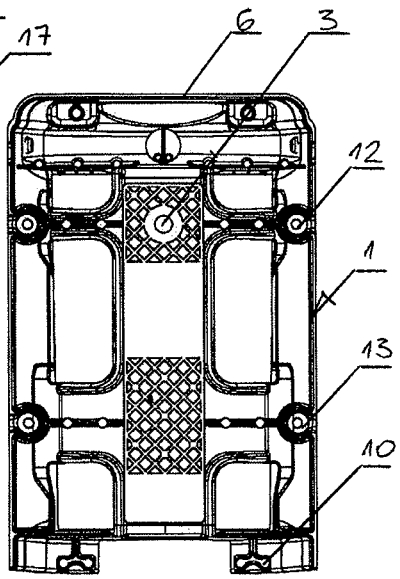
Figure 6:
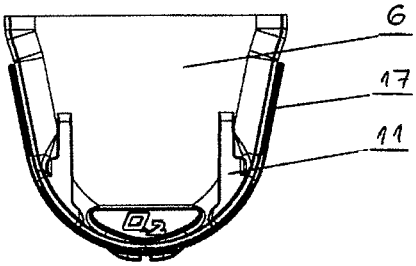
Figure 7:
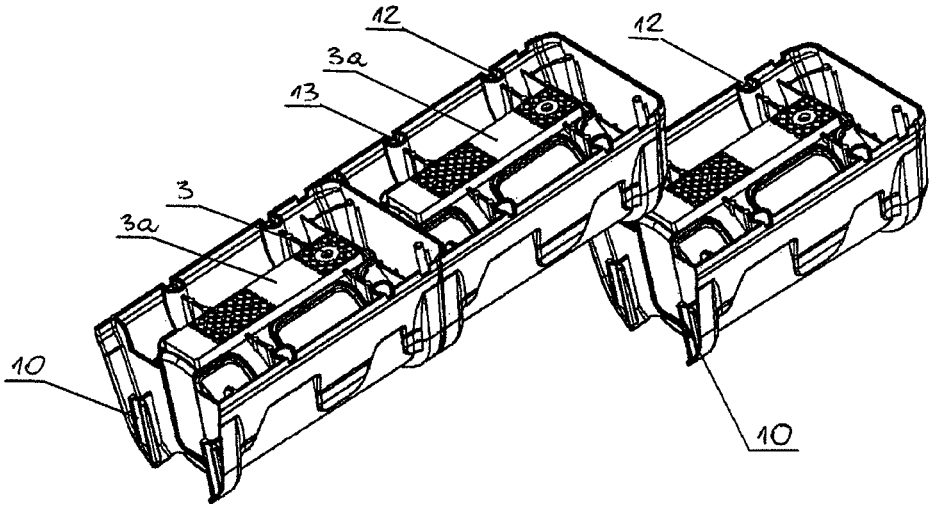
Figure 8:
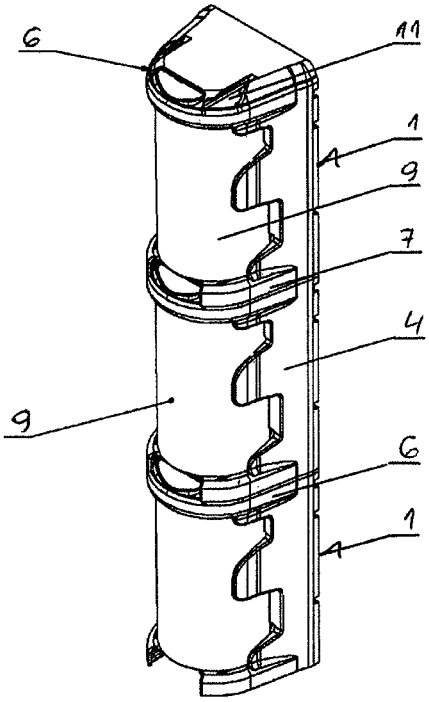
Figure 9:
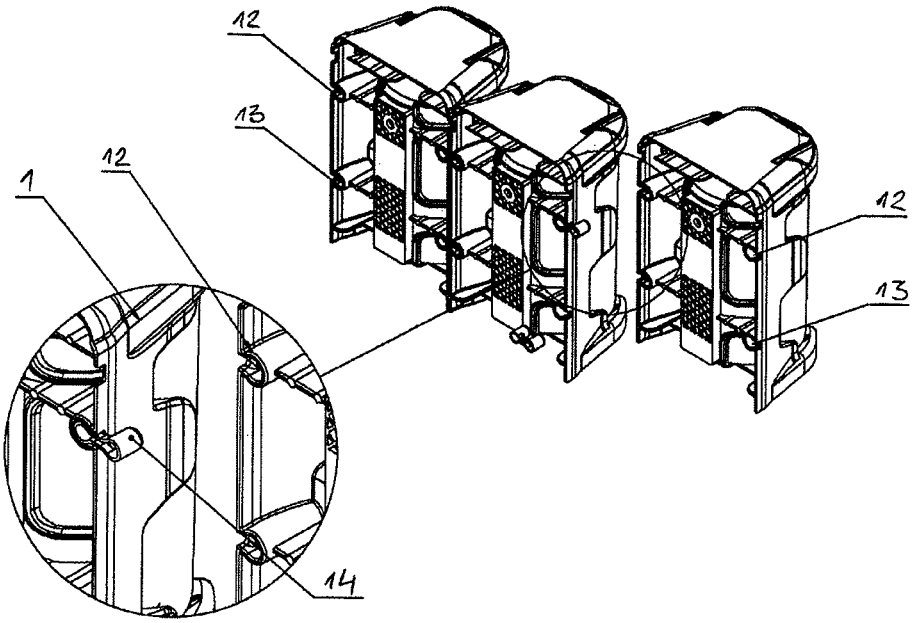
Figure 10:
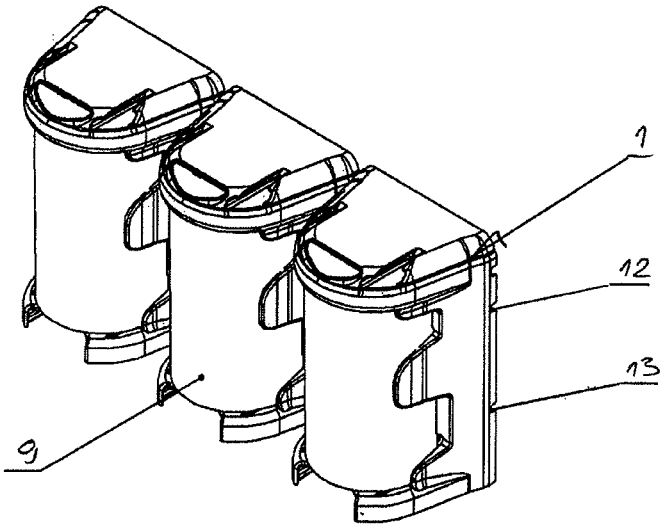
Figure 11:
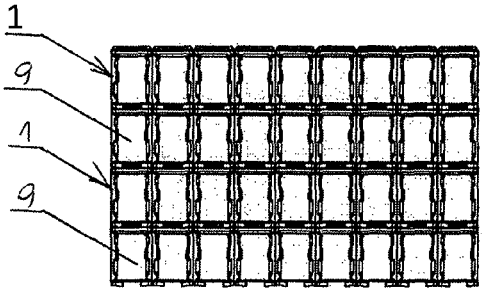
Figure 12:
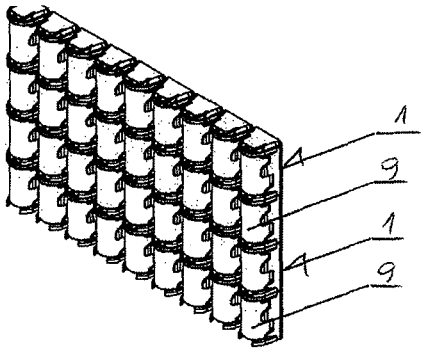
Figure 13:
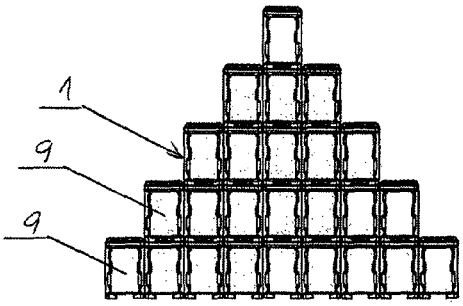
Figure 14:
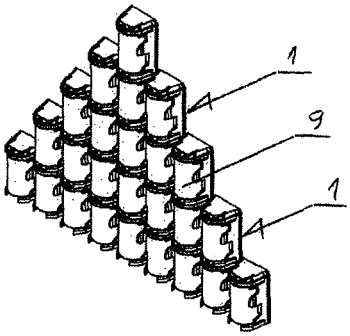
Figure 15:
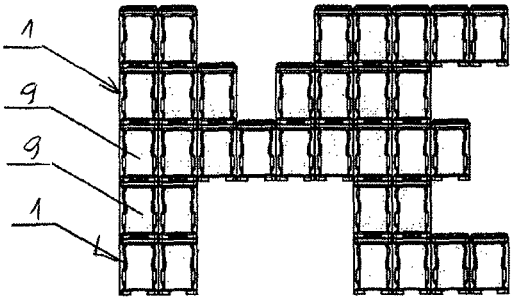
Figure 16:
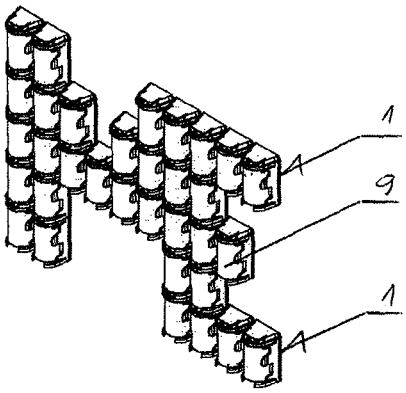
Figure 17:
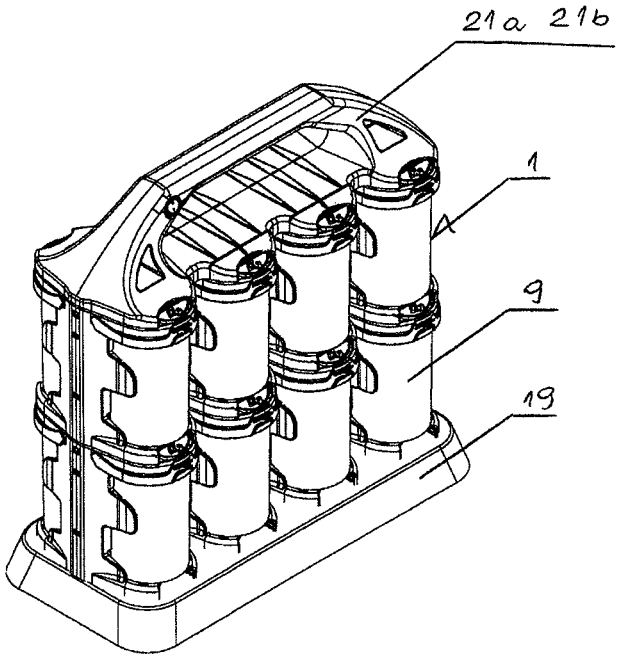
Figure 18:
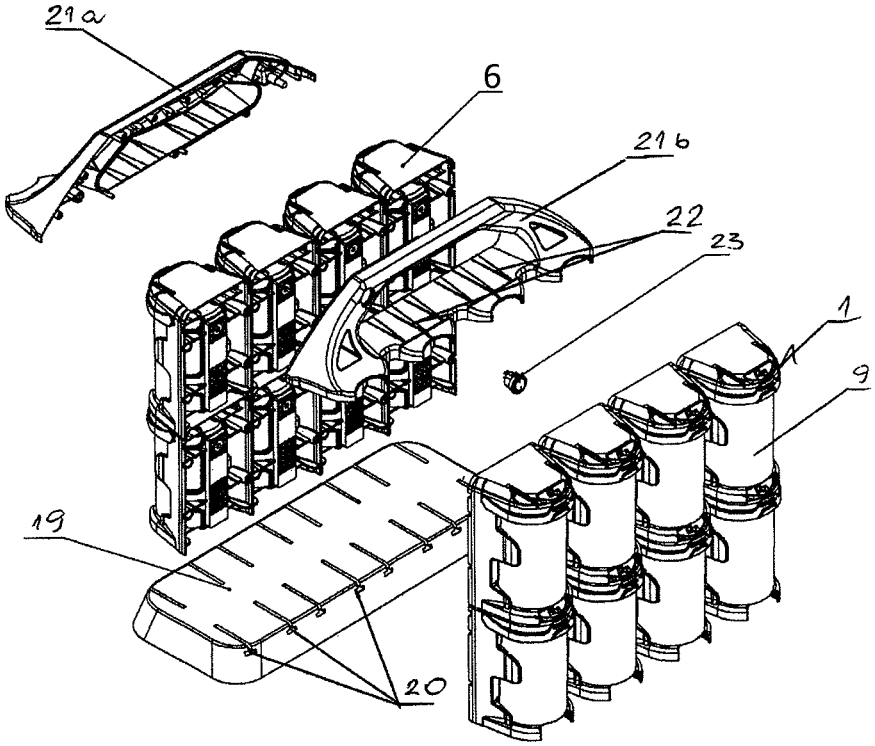

The object of the invention is presented in example of realisation in a picture, where FIG. 1 represents a modular container in axonometric projection viewed from the side, FIG. 2 represents a modular container in axonometric projection, viewed from the side, with the plastic insert absent and the lock taken off, FIG. 3 represents a modular container viewed from the front, FIG. 4 represents a modular container viewed from the side, FIG. 5 represents a modular container viewed from the back, FIG. 6 represents a cover of a modular container viewed from the top, FIG. 7 represents three modular containers in axonometric projection viewed from the back and from the side, showing also the vertical attachment system FIG. 8 represents three modular containers in axonometric projection, viewed from the front and from the side, after attaching them with vertical attachment system, FIG. 9 represents three modular containers in axonometric projection, viewed from the back and the side, showing also the horizontal attachment system, FIG. 10 represents three modular containers in axonometric projection, viewed from the front and from the side, after attaching them with horizontal attachment system, FIG. 11 represents an example arrangement of modular containers with plastic inserts, viewed from the front, FIG. 12 represents an example arrangement of modular containers with plastic inserts in axonometric projection, viewed from the side, FIG. 13 represents an example, pyramid-shaped arrangement of modular containers with plastic inserts, viewed from the front, FIG. 14 represents an example, pyramid-shaped arrangement of modular containers with plastic inserts, in axonometric projection, viewed from the side, FIG. 15 represents an example irregular arrangement of modular containers with plastic inserts, viewed from the front, FIG. 16 represents an example irregular arrangement of modular containers with plastic inserts, in axonometric projection, viewed from the side, FIG. 17 represents an example portable arrangement of modular containers in axonometric projection, viewed from the side, FIG. 18 represents an example portable arrangement of modular containers, showing its components, in axonometric projection, viewed from the side.

A modular container system designed for storing small objects of different purpose with the possibility of arranging it in a multitude of configurations, consisting of at least one container, characterises in having at least one monolithic housing (1) comprising a back wall (2) in the shape of a vertical column in its middle portion.

On the upper portion of the column an opening (3) is placed designed for a screw and an area (3*a*) for double-sided adhesive tape; both allowing to firmly install the housing on any vertical surface.

Sidewalls (4) are created by two flat, vertical projections (4*a*), their back edges forming enclosure of the back wall on both sides of the housing (1).

Connection clips (5) attached to the back wall allow to firmly hold the plastic insert (9), and ensure its upright position and disallow it from falling out of the housing. Moreover, between sidewalls and the vertical column, in the top and bottom portions of the housing insert holders are embedded, which have, within the housing, semicircular gaps, its radius corresponding with the radius of the insert.

The cover (6) comprises a back wall ended with a straight flat surface equipped with pins (16) allowing installation of illumination; a hoop runs around the outer edge of the cover, being semicircular at its front portion, its radius corresponding with the radius of the insert.

The base (7) is underlined with a hoop running from the back walls, its height corresponding with the cover hoop's height. The base in its front portion comprises a concave gap (8) with its arc directed towards the back wall of the housing.

The cover projected from the top and the base projected from the bottom have identical outer contour.

The plastic insert (9) is of cylindrical shape, enclosed at its base. Favourably the insert (9) is transparent.

The vertical attachment system consists of vertical, male, sliding shape connector (10), positioned at the bottom of the base (7), being a boss, which in transverse cross-section is tri-arm shaped, two bottom arms rounded; and a vertical female connector, being a longitudinal slot in the cover (6). In order to attach two containers of the modular system vertically (see FIG. 10) the vertical male connector, positioned at the bottom of the base, is slid into vertical female connector, positioned in the cover (see FIG. 9). To multiply the connection, the action is to be repeated.

The horizontal attachment system consisting of bottom openings (12) and top openings (13) in the sidewalls (4) of the housing (1) and horizontal connector (14), which in transverse cross-section has a shape of two rings linked by a bar. In order to attach two containers of the modular system horizontally (see FIG. 12), the top opening (12) and the bottom opening (13) in the sidewall (4) of the housing (1) are each inserted with one round element of the horizontal connector (14), which in transverse cross-section has a shape of two rings, in such a way, that the second round element of the horizontal connector is slid into the second container, thus linking both containers horizontally (see FIG. 11). To multiply the connection, the action is to be repeated.

A set of two connectors (14) are attached to the display hook located at the top portion of the cover (6); wherein the display hook is an element detached after purchase.

The system of vertical and horizontal attachment allows creating sets of containers depending on needs and free space capabilities. This way two or more containers may be attached, thus creating sets as shown in (FIGS. 11 and 12, FIGS. 13 and 14, FIGS. 15 and 16), or different ones. This system also allows arranging containers bypassing obstacles e.g. sockets.

Moreover the housing (1) may come in different colours, favourably in the colour of the interior.

The modular container system may be of use where arranging small objects, according to own rules, is essential. This system may be used to hold small objects in workshops, garages, offices, or to arrange hobby-related small objects, e.g. in scale modelling, fishing. A solution with possibility to create portable arrangements was created with a view of those, who need to move certain elements to another place. A "case" made from several containers allows to move different objects and if need arises to move other objects, only plastic inserts with their content may be exchanged, without disassembling the whole "case". Additionally, to prevent the plastic inserts from accidental falling out while carrying the "case", a safety system is used, consisting of a lock, being a semicircular bail, fixed on both sides of the upper portion of the housing.

The invention claimed is:

1. A modular container system, consisting of at least one container, characterised in that having at least one monolithic housing (1) consisting a back wall (2) in the shape of a vertical column in its middle portion, having an opening (3) for a screw and an area (3*a*) for double-sided adhesive tape; sidewalls (4) created by two flat, vertical projections (4*a*), their back edges forming enclosure of the back wall; connection clips (5) attached to the back wall; a cover (6) comprising a back wall ended with a straight flat surface equipped with pins (16) allowing installation of illumination, and a hoop that runs around the cover, being semicircular at its front portion; a base (7) underlined with a hoop running from the back walls, in its front portion comprises a concave gap (8) with its arc directed towards the back wall of the housing; a plastic insert (9) of cylindrical shape, enclosed at its base; a vertical attachment system consisting of vertical, male, sliding shape connector (10), positioned at the bottom of the base (7), being a boss, which in transverse cross-section is tri-arm shaped, two bottom arms rounded; and a vertical female connector, being a longitudinal slot in the cover (6); a horizontal attachment system consisting of top openings (12) and bottom openings (13) in the sidewalls (4) of the housing (1) and horizontal connector (14), which in transverse cross-section has a shape of two rings linked by a bar; moreover it contains of a safety system consisting of a lock (17), being a semicircular bail, fixed on both sides of the upper portion of the housing (1), and a system allowing to create a portable configuration, consisting of a base (19) containing a female vertical connector (20) and a handle (21*a*) and (21*b*) containing a male vertical connector (22) allowing to connect it with the housing (1), moreover, the handle is equipped with an illumination operation switch (23).

2. A system according to claim 1, characterised in that joint depth of vertical projections (4*a*) and connection clips (5) is not greater than half of the container's radius.

3. A system according to claim 1, characterised in that the cover's (6) radius, which in its front portion is of semicircular shape, which is correspondent with the container's (2) radius.

4. A system according to claim 1, characterised in that the base's hoop (7) is of the same height as the cover's hoop.

5. A system according to claim 1, characterised in that the plastic insert (9) is transparent.

6. A system according to claim 1, characterised in that the horizontal connector (13) is attached to the display hook (14) designed for hanging on the exhibition shelf, which is an element detachable from the housing (1).

7. A system according to claim 1, characterised in that the housing (1) is in multitude of colours, preferably in the colour of an interior.

8. A system according to claim 1, characterised in that the lock (17) of the safety system which prevents the containers (9) from falling out has projections (18) on the inner portion of the bail's ends.

9. A system according to claim 1, characterised in that the lock (17) of the safety system which prevents the containers (9) from falling out, has, at approximately a quarter length from the bail's end, a thickened area (24).

10. A system according to claim 1, characterised in that the base's (19) width equals doubled housing's (1) depth.

11. A system according to claim 1, characterised in that the base's (19) length equals multiplied housing's (1) width.

12. A system according to claim 1, characterised in that the handle (21*a*, 21*b*) consists of two separable elements.

13. A system according to claim 1, characterised in that the handle's (21*a*, 21*b*) width equals doubled housing's (1) depth.

14. A system according to claim 1, characterised in that the handle's (21*a*, 21*b*) length equals multiplied housing's (1) width.

* * * * *